US005887736A

United States Patent [19]

Mar

[11] Patent Number: 5,887,736

[45] Date of Patent: Mar. 30, 1999

[54] SAFETY CONTAINER REQUIRING TWO SIMULTANEOUS MOVEMENTS TO EFFECT OPENING

[76] Inventor: Bob Mar, 1025 Rosemarie La., No. D-8, Stockton, Calif. 95207

[21] Appl. No.: 944,382

[22] Filed: Oct. 6, 1997

[51] Int. Cl.[6] ..... B65D 55/02; B65D 85/56

[52] U.S. Cl. ..... 215/213; 215/306; 215/301; 215/237; 220/375; 220/326; 220/259; 220/281

[58] Field of Search ..... 215/209, 211, 215/213, 215, 225, 235, 237, 244, 245, 300, 301; 220/375, 339, 281, 283, 315, 324, 326, 259, 258, 263, 264, 501, 505, 527, 528, 553, 555; 264/328.1, 328.8

[56] References Cited

U.S. PATENT DOCUMENTS 3,860,135 1/1975 Yung et al. .
3,924,768 12/1975 Lemons .
4,146,146 3/1979 Mar .
4,257,537 3/1981 Uhlig ..... 215/225 X
4,535,903 8/1985 Franchi ..... 215/213
5,460,288 10/1995 Balzeau ..... 220/326
5,682,910 11/1997 Kizawa et al. ..... 220/326 X

*Primary Examiner*—Stephen K. Cronin
*Assistant Examiner*—Nathan Newhouse
*Attorney, Agent, or Firm*—Bernhard Kreten

[57] ABSTRACT

A container having a hinged stopper with a safety latch to deter unauthorized persons from opening the container. The underside of the stopper is provided with a channel which carries a slide pin movable to first and second positions: a first latching position in which an enlargement at the end of the slide pin is seated in a recess in the lip of the container and a second unlatched position in which the enlargement is freed from the recess enabling the stopper to be opened. The slide pin is biased to the latched position, and the slide pin should be pushed against the bias to unlatch the stopper, and while maintaining this force, the stopper must be simultaneously opened. The requirement of two simultaneous pushing motions is beyond the capability of most young children.

21 Claims, 6 Drawing Sheets

SAFETY CONTAINER REQUIRING TWO SIMULTANEOUS MOVEMENTS TO EFFECT OPENING

FIELD OF THE INVENTION

This invention relates to a container, primarily a safety container for use with medicines or toxic substances which requires manipulation to gain access to the interior.

BACKGROUND OF THE INVENTION

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 3,860,135 | January 14, 1975 | Yung, et al. |
| 3,924,768 | December 9, 1975 | Lemons |
| 4,146,146 | March 27, 1979 | Mar |

This invention involves continuing effort on the applicant's part to develop safety containers. Applicant's prior U.S. Pat. No. 4,146,146 which was an improvement over U.S. Pat. No. 3,860,135 issued to Michael A. Yung and Bob Mar, the applicant herein, and U.S. Pat. No. 3,924,768 issued to John B. Lemons and assigned to the applicant herein.

U.S. Pat. No. 4,146,146 discloses a safety container with a stopper hinged to the lip of the container so as to be movable from a sealed position to an open position. The underside of the stopper is provided with a slide channel which extends only partially across the stopper. A slide pin is mounted in the slide channel for limited reciprocating motion and has an enlarged dovetail shaped end which is insertable in a dovetail recess in the lip of the container to latch the stopper in a closed position.

The enlarged dovetail portion of the pin has an inconspicuous groove which is manipulated by the fingernail of an adult user to effect opening of the container. The inconspicuous fingernail groove is important to the security aspects of the design.

U.S. Pat. No. 3,924,768 discloses a safety container wherein a stopper is hinged to a container having a mouth with a lip surrounding the mouth. The lip is provided with a slideable pin which acts as a dead bolt when reciprocated across the mouth between a closed recess at one end and an opening at the other end. The stopper has a diametrically extending channel open at both ends which registers with the openings in the lip and receives the dead bolt to be locked in the mouth when the dead bolt is inserted.

U.S. Pat. No. 3,860,135 discloses an arrangement similar to that disclosed in 3,924,768 with the exception that the dead bolt is reciprocated in the stopper rather than in the lip.

The apparatus described in this application differs significantly from the prior art described above in primarily enhancing child safety aspects of medicine containers.

SUMMARY OF THE INVENTION

This invention augments child safety by requiring two distinct simultaneous motions to open the stopper of containers. As noted in the prior art discussed above, the pin acting as a dead bolt was first pulled to an open or unlatched position where it rests. As a second separate step the stopper was then lifted out of the mouth of the container.

In the present invention, the pin must be pushed from the resilient rear to the unlatched position and held there by continuous pressure while the stopper is raised at the same time.

Testing with children has demonstrated that it is more difficult for them to defeat the safety feature of a medicine container when two simultaneous motions are required rather than two separated motions.

OBJECTS OF THE INVENTION

The overall object of the invention is to augment the safety of the prior art safety containers by employing a biased reciprocating slide pin to latch and unlatch the stopper with respect to the lip of the container. Instead of pulling the slide pin from the front of the container, it is pushed from the rear by various mechanical expedients. Preferably, a resiliently shaped memory material, wherein the material seeks to return substantially to its original position, biases the slide pin against the mechanical pushing forces. However, other biasing means, such as springs, may also be employed. This arrangement requires a simultaneous pushing force on the slide pin and lifting force on the stopper to overcome friction and thence to open the container.

It is a specific object of the invention to utilize the flexibility of the midway portion of the hinge connecting the stopper and container to transfer finger pressure from the outside to push the slide pin to a forward unlatched position. The process is aided by making the rear portion of the slide channel of a compressible material. As an alternative to pushing the slide open through the hinge, the slide pin may be moved by an externally operated camming structure.

Viewed from a first vantage point, it is an object of the present invention to provide, in combination, a container having a mouth and a lip surrounding the mouth, a recess which extends through the lip, a stopper sized to fit into and conform to the mouth, the stopper having a flange sized to rest against and conform to the lip, a slide channel extending across an underside of the stopper and having a covered rear end and a front open end aligned with the recess, a slide pin slideably disposed in the slide channel and the recess, the slide pin having an enlarged outer front portion and a rear end portion, the enlarged outer front portion sized to fit within the recess so that it cannot be lifted through the recess and a portion immediately adjacent the enlarged outer front portion sized to be lifted through the recess, means for applying a force to the rear end portion of the slide pin for sliding the slide pin from an inserted position where the enlarged outer front portion is seated in the recess to an extended position so that the enlarged outer front portion clears the recess, resilient means for biasing the slide pin to remain in the inserted position, and hinge means connecting the stopper to the lip of the container, enabling a latched position whereby the stopper occludes the mouth of the container and is retained in the latched position by the enlarged outer front portion of the slide pin seated in the lip recess, the hinge means enabling an open position whereby the stopper is unlatched and opened by the application of a force on the rear portion of the slide pin against the biasing means to unseat the enlarged portion and rotating the stopper around the hinge.

Viewed from a second vantage point, it is an object of the present invention to provide, a container and safety stopper combination, a container mouth and lip surrounding the mouth, the stopper including a slide channel, the lip, having a recess aligned with the slide channel, a slide pin slideable in the recess and the slide pin having an enlarged outer portion which fits within the recess when the slide pin is slid to its inserted position but cannot be lifted through the recess, and a portion of the slide pin sized so that it is lifted through the recess when the slide pin is slid to its extended position, and a hinge for connecting the stopper to the container, and biasing means biasing the slide pin to its inserted position, and means for applying a force to a rear portion of the slide pin to move the slide pin to its extended position against the bias means thereby enabling simultaneous lifting of the stopper.

Viewed from a third vantage point, it is an object of the present invention to provide, a container and safety stopper combination, said container having a mouth and a lip surrounding the mouth, a stopper sized to fit into and conform to the mouth, the stopper including a slide channel, the lip having a recess aligned with the slide channel, a pin slideable in said recess and the slide channel from an inserted position to an extended position, the pin having an enlarged outer portion which fits within the recess when the pin is slid to its inserted position but cannot be lifted through the recess, a portion of the pin sized so that it is lifted through the recess when the pin is slid to its extended position, and a hinge for connecting the stopper to the container, and resilient means to bias the slide pin to an inserted position and means to drive the slide pin against the bias to an extended position.

Viewed from a fourth vantage point, it is an object of the present invention to provide a child proof safety container, comprising, in combination, a blind bore having a peripheral lip, a lid hinged to a portion of the lip, a latching engagement means on the lid to latch the lid to the lip, and first and second simultaneous force latching means on the lid to release and displace the lid from the latching engagement with the blind bore to expose an interior of the container.

Viewed from a fifth vantage point, it is an object of the present invention to provide a method for forming a child proof safety container, the steps including forming a gasket with an integrally formed hinge extending from the gasket and an integrally formed slide retainer extending from the hinge, molding a container and lid about the gasket by bonding the gasket with the container and adhering the slide retainer with the lid, and attaching a slide to the slide retainer on an underside of the lid.

Viewed from a sixth vantage point, it is an object of the present invention to provide a method for forming a child proof safety container, the steps including forming a gasket with an integrally formed hinge extending from the gasket and an integrally formed slide retainer extending from the hinge, molding a bottomless container, a lid, and safety seal about the gasket by bonding the gasket with the container and adhering the slide retainer with the lid, inserting contents within the bottomless container, molding a bottom wall onto the bottomless container, and attaching a slide to the slide retainer on an underside of the lid.

Viewed from a seventh vantage point, it is an object of the present invention to provide in a container and safety stopper combination a container mouth and lip surrounding the mouth, the stopper including a slide channel, the lip having a recess aligned with the slide channel, a slide pin slideable in the recess and the slide pin having an enlarged outer portion which fits within the recess when the slide pin is slid to its inserted position but cannot be lifted through the recess, and a portion of the slide pin sized so that it is lifted through the recess when the slide pin is slid to its extended position, and a hinge for connecting the stopper to the container, biasing means biasing the slide pin to its inserted position, and means for applying a force to a rear portion of the slide pin to move the slide pin to its extended position against the bias means thereby enabling simultaneous lifting of said stopper, and a safety membrane integrally formed with the container, parallel to a bottom container wall, positioned below the biasing means, including a tab extending from the safety membrane upward toward the stopper, and a thinner outer periphery that is solid yet capable of being easily torn.

Viewed from a eighth vantage point, it is an object of the present invention to provide a tamper-evident seal comprising, in combination, a fictile impervious membrane having a top surface, a bottom surface, and a frangible periphery about said membrane, and a tab integrally formed and projecting from the membrane top surface.

These and other objects will be made manifest when considering the following detailed specification when taken in conjunction with the appended drawing figures.

DESCRIPTION OF PREFERRED EMBODIMENTS

Figure 2:
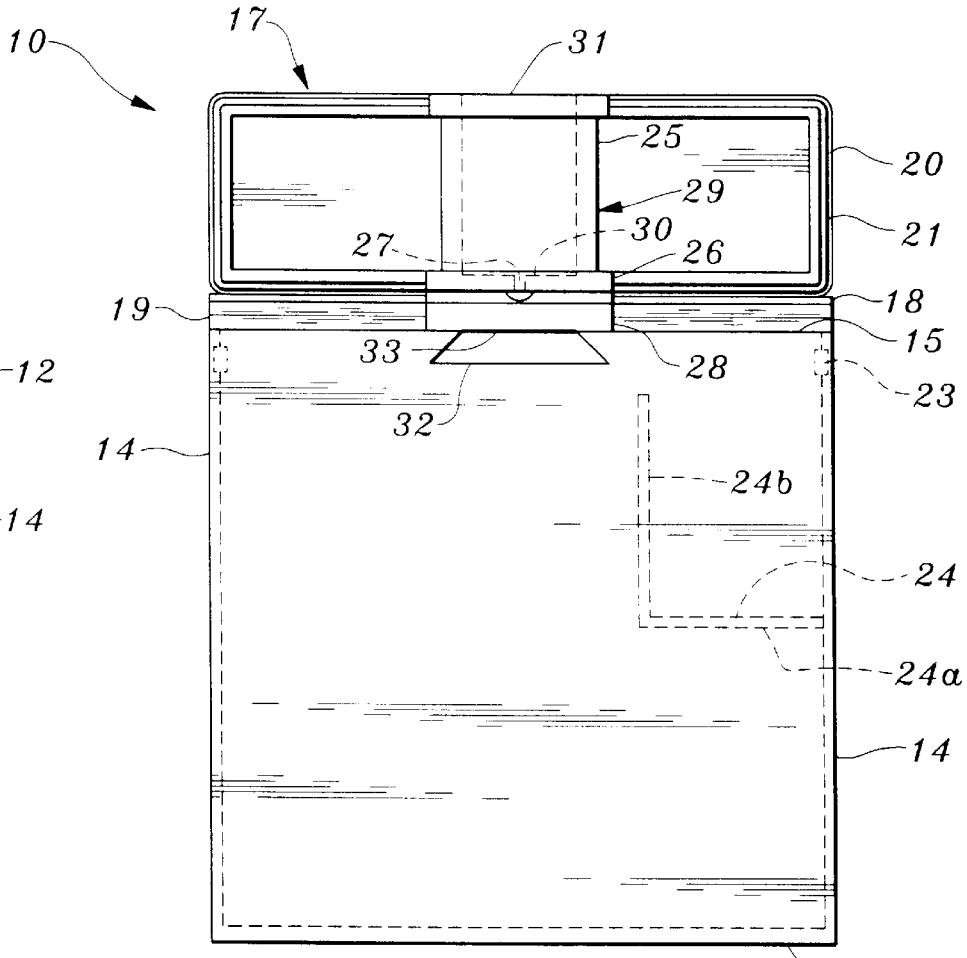
FIG. 2 is a front view of a first embodiment of the invention with the stopper in an open position and showing an internal ledge or pocket.

Considering the drawings, wherein like reference numerals denote like parts throughout the various drawing figures, reference numeral 10 is directed to the overall safety container according to the present invention. While the safety container of this invention can be round, square, oblong, or any shape, it is preferred to employ a rectangular container that can be easily carried on the person, and the invention will be described in terms of this shape.

In its essence, the container 10 includes an openable structure defining a blind bore 60, a peripheral gasket 23 circumscribing a top peripheral edge of the bore 60 and an integrally formed stopper defining a hinged lid 80.

Referring now in particular to FIGS. 1–6 and 9, a rectangular container is shown having a front wall 11, a rear wall 12, a bottom wall 13 and two similar side walls 14. The open top of the container is defined by a lip 15 which surrounds a mouth 16 (FIG. 9) designed to receive stopper 17 in a hermetically sealed relationship.

The stopper 17 is hinged to the top of the rear wall 12 for its entire length by means of hinge 18 best shown in FIGS. 2, 3*a*–3*d* and 9. Wall 12 is raised above the lip 15 of the front wall 11 as shown at 19 in FIGS. 2 and 3*d* so as to provide a properly positioned pivot axis to enable an accurate closure when the stopper 17 is rotated along arrow A (FIG. 3*d*) into sealing position in mouth 16. Sidewalls 14 (FIG. 3*d*) both have a lip colinear with front wall lip and a gusset 19*a* which transitions to raised wall 19.

Figure 4:
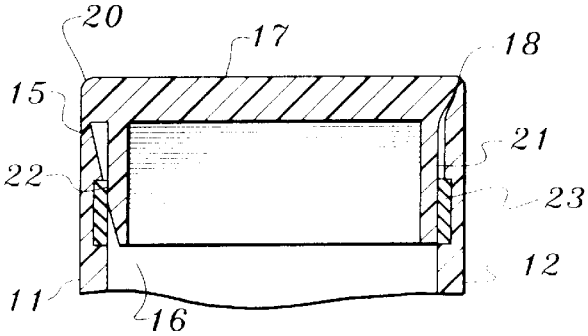
FIG. 4 is a sectional view taken along lines 4—4 of FIG. 1 showing the stopper in a sealed position in the mouth of the container.
Figure 5:
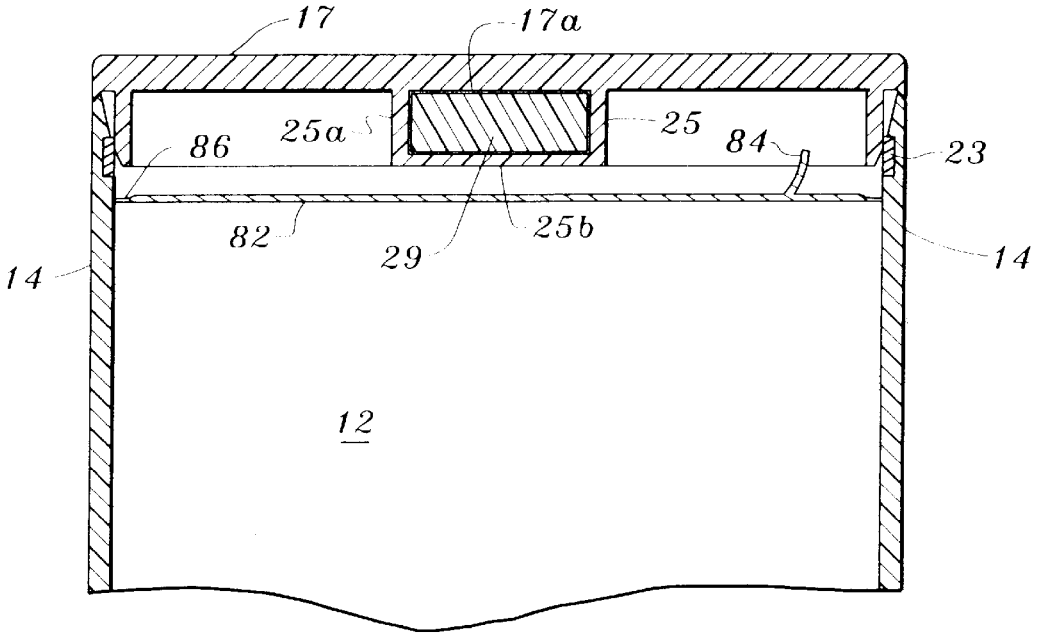
FIG. 5 is a sectional view taken along lines 5—5 of FIG. 1 also showing a safety-seal membrane tab.
Figure 9:
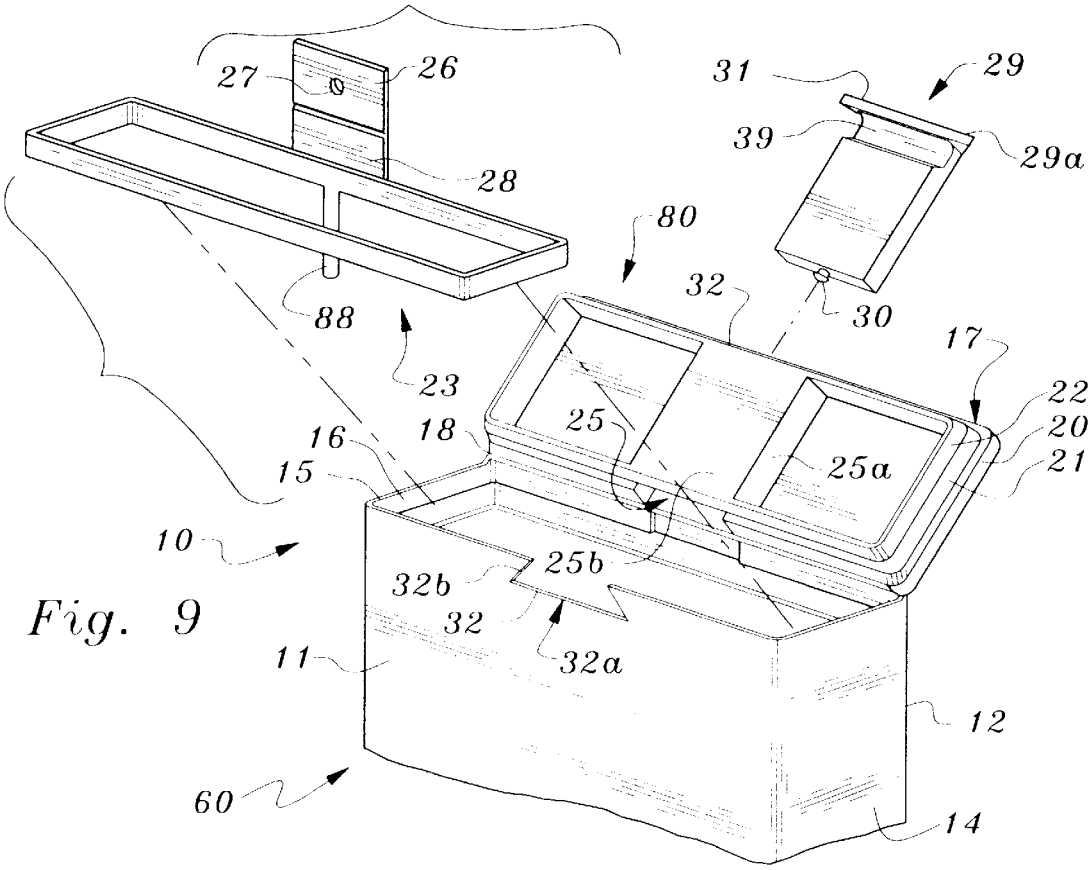
FIG. 9 is an exploded view of the container of the first embodiment with the stopper open, the slide pin projected and the gasket projected.

As best shown in FIG. 9, in order to provide an effective seal between the stopper 17 and bore 60, the stopper 17 is provided with a flange 20 which rests on lip 15 in the closed position. Spaced inwardly of flange 20 is a rectangular neck 21 with a beveled edge 22. As best shown in FIG. 4, when stopper 17 is rotated around hinge 18, neck 21, guided by beveled edge 22, the stopper 17 enters mouth 16 and comes to rest when flange 20 rests on lip 15. In this closed position, the bottom of neck 21 frictionally presses against a soft gasket 23 which rings the interior of the mouth to provide an effective seal.

Figure 12:
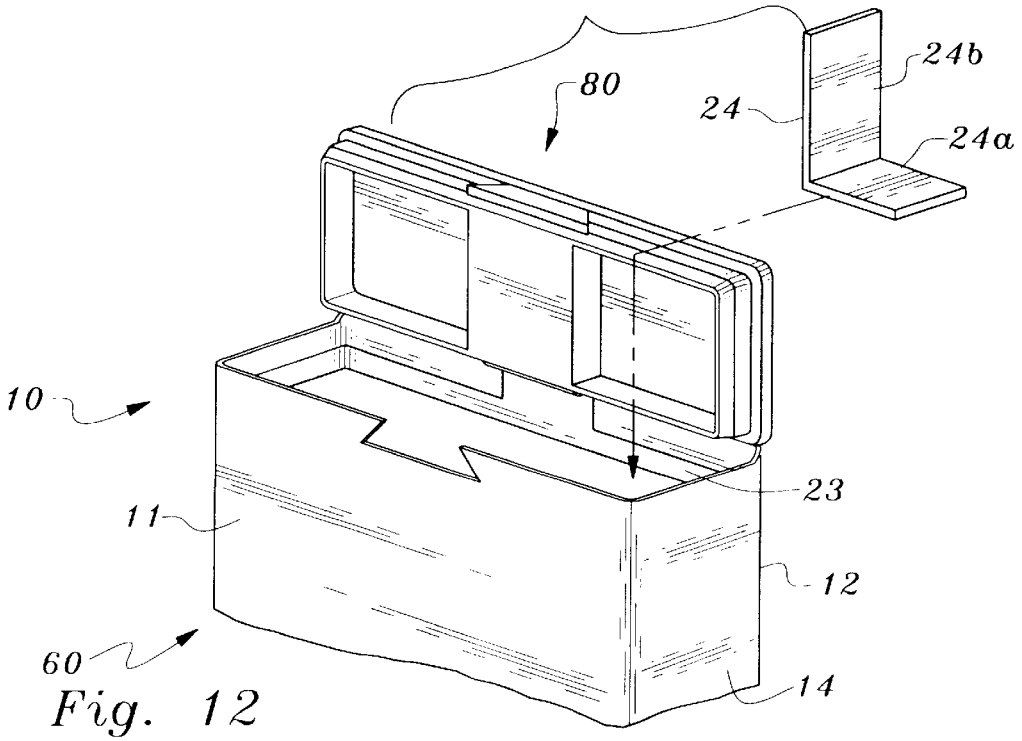
FIG. 12 is an exploded view of the container with the pocket projected.

A pocket 24 may be added to the container to hold a small quantity of pills. Thus, the pocket 24 includes a horizontal shelf 24*a* and a vertical partition 24*b* (FIGS. 2 and 12) extending between front wall 11 and rear wall 12. The walls of the pocket also act as stiffening agents for the container.

The structure so far described is a "flip top" container not having any appreciable child protection. One focal point of this invention involves the provision of a safety latch for a flip top container of the type described above.

Figure 6:
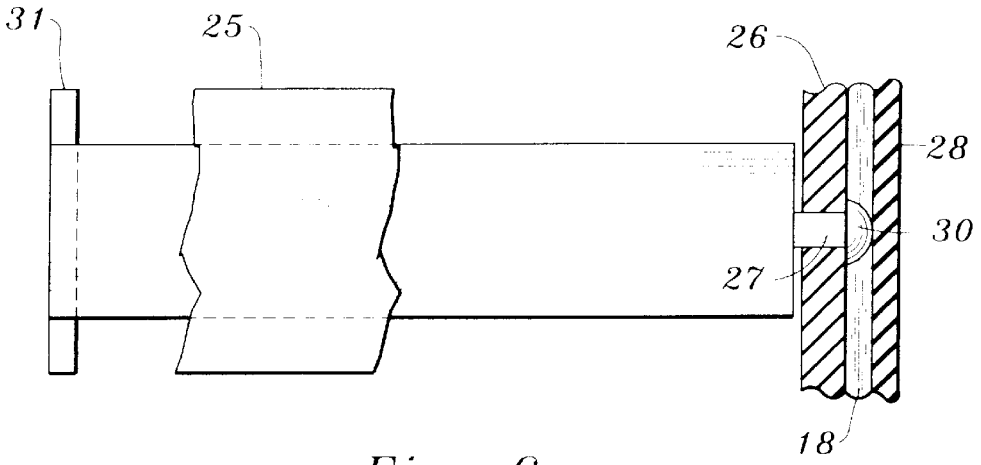
FIG. 6 is a partial schematic top view of the slide pin used in FIGS. 1–5.

Referring now to the embodiment of the invention shown in FIGS. 1–6 and 9, a slide channel 25 with an open front is integrally formed on the underside of the stopper 17, preferably at a medial location, to extend entirely across the width of the stopper 17. A rear wall cap 26 of the channel 25 is closed off with a resilient plastic material. This rear wall cap 26 is integrally formed with the hard plastic of the stopper 17, shown in FIGS. 3*a*, 3*b* and 9 by sequential molding. The channel 25 is formed with two vertical walls 25*a* (FIG. 5) depending from a bottom surface of stopper 17. Vertical walls 25*a* are connected at extremities remote from stopper 17 by a wall 25*b* parallel to stopper 17. The front end of channel 25, opposite rear wall cap 26 is open to receive slide pin 29. The portion of the rear wall cap 26 which forms the end wall of the channel is provided with a central hole 27. As best seen in FIGS. 2, 6 and 9 rear wall cap 26 is integrally attached with elastic hinge section 18 and forms part of wall 19 as shown in FIG. 2.

Figure 1:
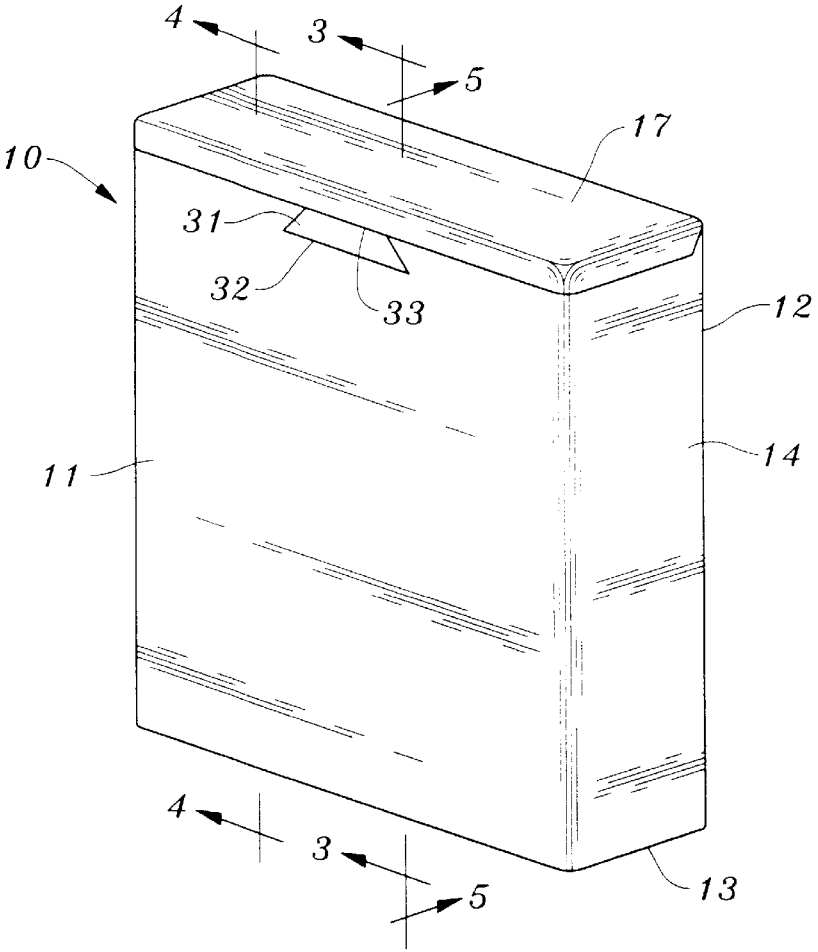
FIG. 1 is an isometric view of the container and stopper of the invention with the stopper closed.
Figure 3A:
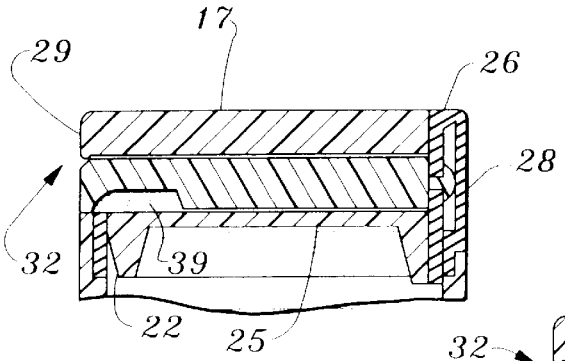
FIGS. 3*a*–3*d* are partial sectional views of the first embodiment taken along lines 3—3 of FIG. 1 showing the manner in which the container is opened and closed.
Figure 3B:
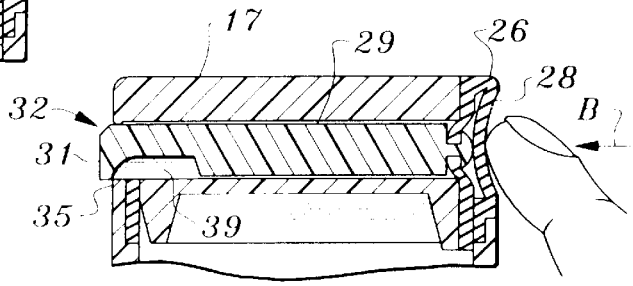
Figure 3C:
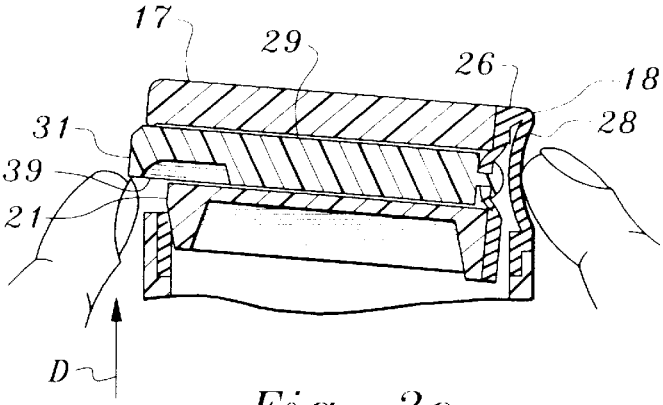

A generally rectangular latching slide pin 29 is mounted in slide channel 25 for minor reciprocating motion to latch and unlatch the stopper 17. A headed tail piece 30 is integrally formed on the back end of the slide pin 29 and forced through hole 27 (FIGS. 3*d* and 9) so that the rear wall cap 26 captures the tail piece 30 and the end of the slide pin 29. A dovetail opening 32 is formed in front wall 11 having a bottom edge 32*a* parallel to lip 15 and side edges 32*b* inwardly angled from bottom 32*a* to lip 15. The front end 29*a* of the slide pin 29 is formed with a dovetail enlargement 31 which is complimentarily received within the dovetail opening 32 formed in lip 15. As shown in FIGS. 1 and 3*a*, when the slide pin 29 is in its rear or inserted latched position, dovetail 31 fits snugly in dovetail opening 32 and the stopper 17 cannot be opened. As shown in FIG. 3*b*, to open the stopper 17 the slide pin 29 is pushed forwardly or extended along arrow B so that the dovetail 31 clears opening 32 and the stopper 17 can be raised since the width of the slide pin 29 behind the dovetail enlargement 31 is slightly less than the gap 33 in dovetail opening 32 as shown in FIG. 3*c*.

One further hallmark in this invention over applicant's prior efforts centers around the provision of a biasing means now to be described. The slide pin 29 is inserted in channel 25 until headed tail piece 30 is forced through central hole 27 in rear wall cap 26. The stopper 17 is then closed and the slide pin 29 is positioned in the latched position with dovetail 31 seated in dovetail opening 32. By pressing along arrow B, slide pin 29 moves against the bias means of the resiliently shaped memory material, wherein the material seeks to return substantially to its original position, while force B moves the dovetail enlargement 31 forward of the dovetail opening 32 to unlatch the stopper 17 as shown in FIGS. 3*b* and 3*c*.

The operation of the FIGS. 1–6 embodiment will be explained with reference to FIGS. 3*a*–3*d*. FIG. 3*a* is a part schematic view showing the relationship of the parts when the stopper 17 is closed as shown in FIG. 1. In this position dovetail enlargement 31 is seated in dovetail opening 32 to latch the stopper 17 in a closed position.

As shown in FIG. 3*b*, when (finger) pressure along arrow B is exerted against elastic hinge section 28, pressure is applied to tail piece 30 which in turn moves the slide pin forwardly against the memory of rear wall cap 26. As long as finger pressure exceeds the compression biasing pressure, front wall 35 of recess 39 will be spaced from lip 15 and the dovetail enlargement 31 will be pushed out of the dovetail opening 32 in an unlatched position. The required movement of the slide pin 29 to effect latching and unlatching is only a small fraction of an inch or the distance necessary for the dovetail enlargement 31 to clear the wall thickness of the container at the lip 15.

FIG. 3*c* shows stopper 17 being raised around pivot 18. With continued finger pressure maintained on elastic hinge section 28, dovetail enlargement 31 remains disengaged as explained in connection with FIG. 3*b*. While maintaining this pressure, the neck 21 of the stopper 17 is simultaneously lifted out of the mouth 16 by (finger) pressure on the exposed dovetail enlargement 31 thereby rotating the slide pin 29 through the dovetail gap 33 and moving the stopper 17 to an open position. As an aid in lifting the stopper 17, a finger grip formed by recess 39 is provided in the slide pin 29 behind the dovetail enlargement 31.

Figure 3D:
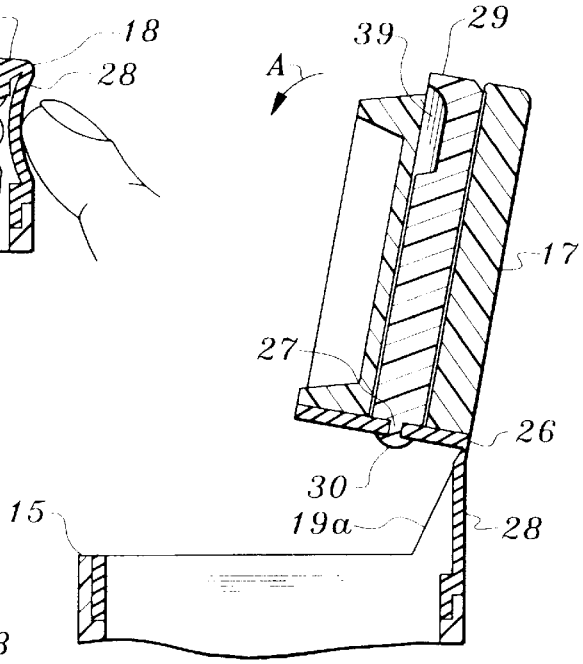

FIG. 3*d* shows the stopper 17 in a completely open position. With finger pressure removed, the bias means of the resiliently shaped memory material restores the slide pin 29 to its rest position with headed tail piece 30 coming to rest against opening 27. To close the stopper 17, the stopper 17 is preferably merely released and closes by its own weight.

Figure 7:
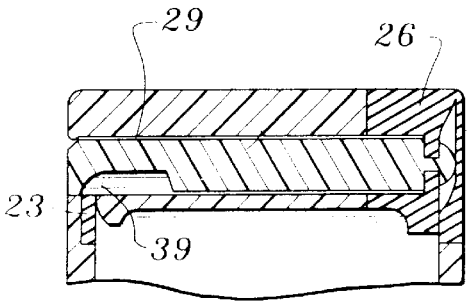
FIG. 7 is a sectional view similar to FIG. 3*a* showing a second embodiment of the invention.
Figure 11:
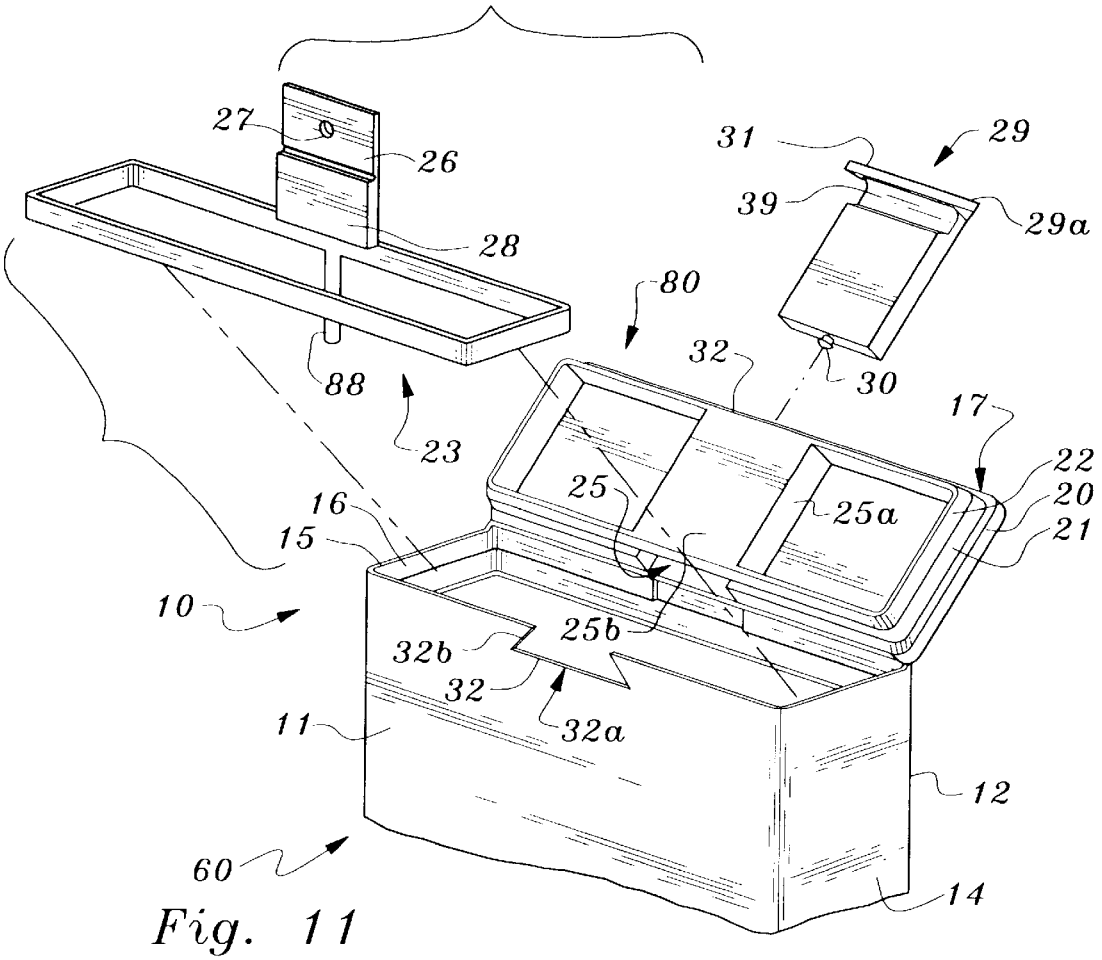
FIG. 11 is an exploded view of the container of the FIG. 7 type with the stopper open, the slide pin projected and the gasket projected.

FIGS. 7 and 11 show another embodiment of the invention. In this embodiment the thickness of rear wall cap 26 is increased, as is its extension and pressure into the stopper 17 and channel 25, thereby allowing for a different resiliency.

Figure 8:
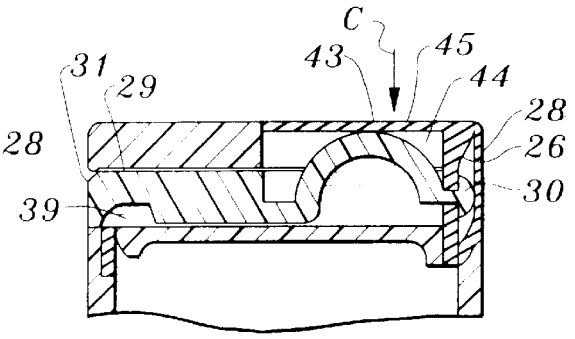
FIG. 8 is a sectional view similar to FIG. 3*a* showing a third embodiment of the invention.
Figure 10:
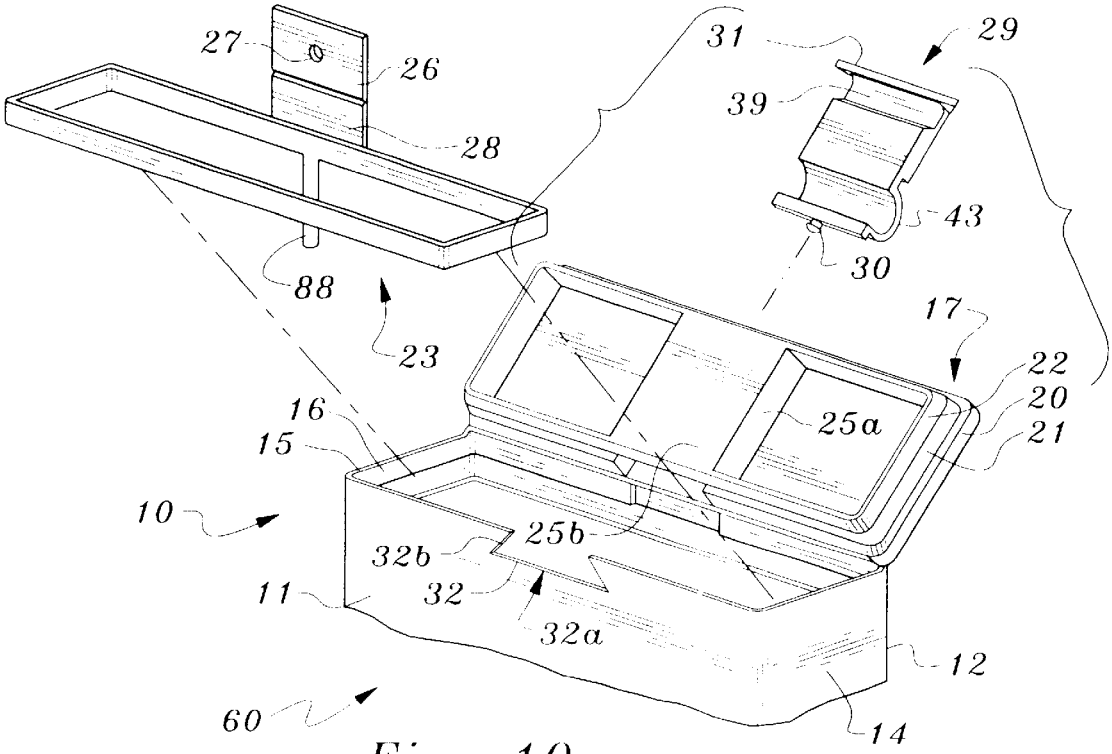
FIG. 10 is an exploded view of the container of the FIG. 8 type with the stopper open and the slide pin projected.

FIGS. 8 and 10 show a third embodiment of the invention. Slide pin 29 is provided with a C-shaped flexible loop 43 between headed tail piece 30 and the rear end of the slide pin 29. Flexible loop 43 is accommodated in a stopper recess 44 which is covered by an elastic cover 45. Finger pressure along vertical arrow C on cover 45 extends flexible loop 43 horizontally to unlatch the dovetail enlargement 31 in the same manner taught in the first and second embodiments. It should also be noted that the third embodiment can also be operated in the same manner as the FIGS. 3*a*–3*d* embodiment by finger pressure at elastic hinge 28. This dual capability is an advantage to first time users who are more inclined to provide opening pressure at the top rather than the rear side.

A preferred method of manufacturing this invention is by means of injection molding. Using a material of appropriate biasing properties, soft gasket 23 and elastic hinge section 28 are first molded as a unitary element. Next, bore 60 and stopper 17 are molded into a hardened plastic onto and combined around the first above-mentioned gasket/hinge combination. The combination is thereafter moved to a cooling area, cooled, and ejected. Using a third hard plastic material, the slide pin 29 is separately molded and stands alone as a separate piece to be inserted into slide channel 25.

In its essence, in its use and operation one presses along arrow B as seen in FIG. 3*b* parallel to stopper 17 with sufficient force to overcome the bias of elastic hinge section 28 and continuing to press until slide pin 29 extends beyond dovetail opening 32. One could also, if designed as described in FIGS. 8 and 10, press down along arrow C and accomplish the same result. Thereafter, while continuing to hold slide pin 29 beyond dovetail opening 32, dovetail enlargement 31 of slide pin 29 is pushed upward along arrow D as shown in FIG. 3*c* until the friction between soft gasket 23 and beveled-edge 22 of flange 20 is overcome causing the stopper 17 to pop open allowing access to the contents of container 10.

To close container 10, stopper 17 is pressed downward or dropped into bore 60 until beveled-edge 22 engages frictionally with soft gasket 23. Due to the resilient memory properties or biasing means of elastic hinge section 28, slide pin 31 returns to a closed position where dovetail enlargement 31 is again aligned with dovetail opening 32 and does not extend past lip 15 so that container 10 is again secured.

Figure 13:
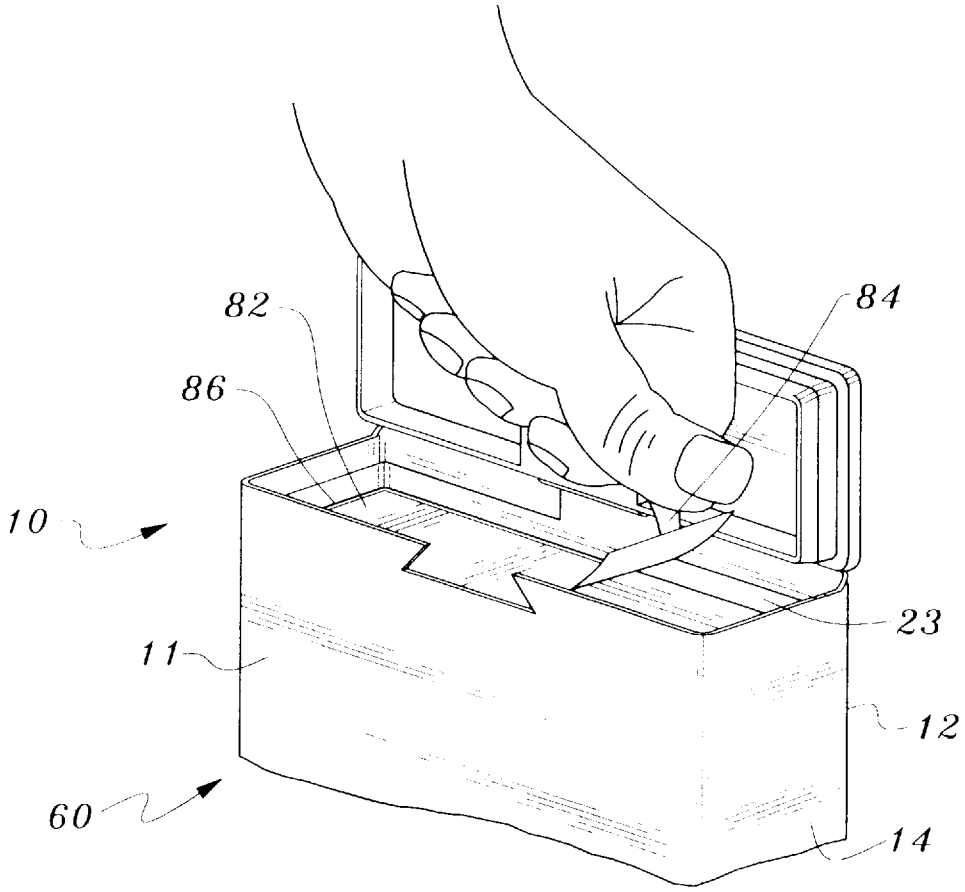
FIG. 13 is an isometric view of the container depicting opening of the safety-seal membrane via the tab.

In an alternative embodiment, as depicted in FIG. 13 (see also FIG. 5), a safety membrane 82 is included contiguous with container 10 slightly beneath gasket 23. Where the above embodiments allowed for adding contents such as pills to container 10 from time to time by a user, this embodiment intends including contents such as pills within the container 10 in a safety sealed environment by a pill manufacturer for procurement by a user. A tab 84 is included on safety membrane 82 so that a user may peel the safety membrane 82 off of container 10 by pulling on tab 84. Although safety membrane 82 is of a thickness similar to walls 11, 12 of container 10, a thin, weak edge 86 is included around the periphery of safety membrane 82 to facilitate the detachment thereof while maintaining a sealed environment. This tabbed safety membrane offers easier removal over existing foil adhesive membranes and a greater assurance of sealing versus old adhesive-type membranes which may or may not adhere. The old foil membranes required piercing and cleanup peeling for removal which was an annoyance to the user, not to mention, the possibility of contamination of the contents by pieces of foil membrane falling therein.

The process of manufacturing this type of container is slightly different also. Instead of molding the whole container 10 around gasket 23 as described above, safety membrane 82 including tab 84 and weak edge 86 are simultaneously added to the container molding. However, bottom wall 13 is added in a next step by similar molding procedures after contents, such as pills, are inserted into the bottomless container. Once the non-removable, bottom wall 13 is added, the contents are therefore sealed therein.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. In combination:

a container having a mouth and a lip surrounding the mouth, a recess which extends through said lip;

a stopper sized to fit into and conform to said mouth, said stopper having a flange sized to rest against and conform to said lip;

a slide channel extending across an underside of said stopper and having a covered rear end and a front open end aligned with said recess;

a slide pin slideably disposed in said slide channel and said recess, said slide pin having an enlarged outer front portion and a rear end portion, said enlarged outer front portion sized to fit within said recess so that it cannot be lifted through said recess and a portion immediately adjacent said enlarged outer front portion sized to be lifted through the recess;

means for applying a force to said rear end portion of said slide pin for sliding said slide pin from an inserted position where said enlarged outer front portion is seated in said recess to an extended position so that said enlarged outer front portion clears said recess;

resilient means for biasing said slide pin to remain in said inserted position; and hinge means connecting said stopper to said lip of said container, enabling a latched position whereby said stopper occludes said mouth of said container and is retained in said latched position by said enlarged outer front portion of said slide pin seated in said lip recess, said hinge means enabling an open position whereby said stopper is unlatched and opened by the application of a force on said rear portion of said slide pin against said biasing means to unseat said enlarged portion and rotating said stopper around said hinge.

2. The combination of claim 1 wherein said means for applying said force to said rear portion of said slide pin comprises pressure acting against an outer surface of said hinge in confronting relationship with said slide pin.

3. The combination of claim 2 wherein said rear portion of said slide channel including said covered rear end is made of an elastic material, an opening in said rear cover, and a tail piece at said rear end of said slide pin inserted through said opening to lie in abutting relationship with said hinge.

4. The combination of claim 3 including a flexible loop between said slide pin and said tail piece whereby said slide pin can be actuated by pressure on said loop as well as said hinge.

5. The combination of claim 3 wherein said elastic material at said rear portion of said slide channel is made integral with said hinge.

6. The combination of claim 1 wherein said recess in said lip and said enlargement on said slide pin form a dovetail connection.

7. The combination of claim 1 wherein said container and stopper are rectangular in shape with a front and rear side wall joined by two side walls, said lip recess being medially located on said container front wall and said stopper rear wall being integrally hinged to said container rear wall.

8. In a container and safety stopper combination:

a container mouth and lip surrounding said mouth, said stopper including a slide channel, said lip having a recess aligned with said slide channel, a slide pin slideable in said recess and said slide pin having an enlarged outer portion which fits within said recess when said slide pin is slid to its inserted position but cannot be lifted through the recess, and a portion of said slide pin sized so that it is lifted through said recess when said slide pin is slid to its extended position, and a hinge for connecting the stopper to the container; and biasing means biasing said slide pin to its inserted position, and means for applying a force to a rear portion of said slide pin to move said slide pin to its extended position against said bias means thereby enabling simultaneous lifting of said stopper.

9. The invention of claim 8 wherein said rear portion of said slide pin in its inserted position abuts said hinge, and said means for applying a force comprises pressure applied against said hinge.

10. The invention of claim 8 including a flexible loop between said rear portion of said pin and said hinge, and the means for applying a force comprises pressure applied to said loop.

11. In a container and safety stopper combination:

said container having a mouth and a lip surrounding said mouth, a stopper sized to fit into and conform to said mouth, said stopper including a slide channel, said lip having a recess aligned with said slide channel, a pin slideable in said recess and said slide channel from an inserted position to an extended position, said pin having an enlarged outer portion which fits within said recess when said pin is slid to its inserted position but cannot be lifted through said recess, a portion of said pin sized so that it is lifted through said recess when said pin is slid to its extended position, and a hinge for connecting said stopper to said container; and resilient means to bias said slide pin to an inserted position and means to drive said slide pin against said bias to an extended position.

12. The invention of claim 11 wherein said container and stopper are rectangular in shape with a front and rear wide wall joined by two narrower side walls, said lip recess being medially located on said container front wall and said stopper rear wall being integrally hinged to said container rear wall.

13. A child proof safety container, comprising, in combination:

a blind bore having a peripheral lip;

a lid hinged to a portion of said lip;

a resiliently biased latching engagement means on said lid including a slide pin constrained in a slide channel coextensive with said lid to latch said lid to said lip;

first and second simultaneous force latching means on said lid to release and displace said lid from said latching engagement with said blind bore to expose an interior of said container.

14. The combination of claim 13 wherein said latching engagement means comprises said slide pin slideably disposed within said lid, said slide pin having first and second ends.

15. The combination of claim 14 further comprising said resiliently biased latching means juxtaposed between a first edge of said lid and said slide pin first end, said slide pin second end uniting with a second edge of said lid to so latchably engage said lid to said lip, so that by asserting first simultaneous force means upon said lid, said resilient means, and said slide pin first end, and simultaneously applying said second force means to said slide pin second end, said lid disengages from said lip, exposing said interior of said container.

16. The combination of claim 15 wherein said resiliently biased latching means is coupled to both said lid and said hinge.

17. The combination of claim 16 further comprising an L-shaped ledge within said container below said lip.

18. The combination of claim 17 wherein said first and second simultaneous force means comprise finger pressure.

19. A method for forming a child proof safety container, the steps including:

forming a gasket with an integrally formed hinge extending from the gasket and an integrally formed slide retainer extending from the hinge;

molding a container and lid about the gasket by bonding the gasket the container and adhering the slide retainer with the lid;

attaching a slide to the slide retainer on an underside of the lid; and biasing the slide to maintain a locked position in the absence of opening pressure against the slide.

20. A method for forming a child proof safety container, the steps including:

forming a gasket with an integrally formed hinge extending from the gasket and an integrally formed slide retainer extending from the hinge;

molding a bottomless container, a lid, and safety seal about the gasket by bonding the gasket with the container and adhering the slide retainer with the lid;

inserting contents within said bottomless container;

molding a bottom wall onto said bottomless container;

attaching a slide to the slide retainer on an underside of the lid; and biasing the slide to maintain a locked position in the absence of opening pressure against the slide.

21. In a container and safety stopper combination:

a container mouth and lip surrounding said mouth, said stopper including a slide channel, said lip having a recess aligned with said slide channel, a slide pin slideable in said recess and said slide pin having an enlarged outer portion which fits within said recess when said slide pin is slid to its inserted position but cannot be lifted through the recess, and a portion of said slide pin sized so that it is lifted through said recess when said slide pin is slid to its extended position, and a hinge for connecting the stopper to the container;

biasing means biasing said slide pin to its inserted position, and means for applying a force to a rear portion of said slide pin to move said slide pin to its extended position against said bias means thereby enabling simultaneous lifting of said stopper; and a safety membrane integrally formed with said container, parallel to a bottom container wall, positioned below said biasing means, including a tab extending from said safety membrane upward toward said stopper, and a thinner outer periphery that is solid yet capable of being easily torn.

* * * * *